US010427897B2

(12) United States Patent
Park et al.

(10) Patent No.: US 10,427,897 B2
(45) Date of Patent: Oct. 1, 2019

(54) PICKUP ROLLER HAVING FRONT END ALIGNMENT MEMBER AND MEDIUM SEPARATING DEVICE USING SAME

(71) Applicant: NAUTILUS HYOSUNG INC., Seoul (KR)

(72) Inventors: Sung Ho Park, Seoul (KR); Jin Hwan Cha, Ayang-si (KR); Jae Hoon Kwak, Seoul (KR)

(73) Assignee: NAUTILUS HYOSUNG INC., Seoul (KR)

( * ) Notice: Subject to any disclaimer, the term of this patent is extended or adjusted under 35 U.S.C. 154(b) by 0 days.

(21) Appl. No.: 15/751,833

(22) PCT Filed: Aug. 3, 2016

(86) PCT No.: PCT/KR2016/008560
§ 371 (c)(1),
(2) Date: Feb. 9, 2018

(87) PCT Pub. No.: WO2017/026730
PCT Pub. Date: Feb. 16, 2017

(65) Prior Publication Data

US 2018/0229952 A1 Aug. 16, 2018

(30) Foreign Application Priority Data

Aug. 10, 2015 (KR) ..... 10-2015-0112384

(51) Int. Cl.
*B65H 3/06* (2006.01)
*B65H 9/00* (2006.01)
(Continued)

(52) U.S. Cl.
CPC ..... *B65H 3/0661* (2013.01); *B65H 3/0638* (2013.01); *B65H 3/0676* (2013.01);
(Continued)

(58) Field of Classification Search
CPC ..... B65H 1/02; B65H 3/06; B65H 3/0638; B65H 3/0653; B65H 3/0661;
(Continued)

(56) References Cited

U.S. PATENT DOCUMENTS 5,372,359 A * 12/1994 Miura ..... B65H 3/0638 271/119
6,880,822 B2 4/2005 Fukushima et al.
(Continued)

FOREIGN PATENT DOCUMENTS

JP 05-016745 U 3/1993
JP 07-019283 U 4/1995
(Continued)

OTHER PUBLICATIONS

PCT International Search Report, PCT/KR2016/009285, dated Nov. 23, 2016, 3 Pages.

*Primary Examiner* — Prasad V Gokhale
(74) *Attorney, Agent, or Firm* — Fenwick & West LLP

(57) ABSTRACT

Provided herein may be a pick-up roller with a front-edge alignment element and a media separation apparatus using the pick-up roller. The pick-up roller may include a pick-up element configured to pick up and transfer a media sheet, and the front-edge alignment element provided at a position opposite to the pick-up element. During a process of picking up a stacked media sheet and transferring it into a space between a feed roller and a separation roller unit, the front-edge alignment element may align in advance a front edge of a media sheet disposed subsequent to the medial sheet that is being transferred, to a position of the entrance between the feed roller and the separation roller unit, and thereafter, the pick-up element may pick up the media sheet
(Continued)

aligned by the front-edge alignment element and transfer it into the space between the feed roller and the separation roller unit.

6 Claims, 5 Drawing Sheets

(51) Int. Cl.
*G07D 11/00* (2019.01)
*B65H 3/66* (2006.01)

(52) U.S. Cl.
CPC ..... *B65H 3/66* (2013.01); *B65H 9/006* (2013.01); *G07D 11/00* (2013.01); *B65H 2404/1112* (2013.01); *B65H 2404/1118* (2013.01); *B65H 2404/1122* (2013.01); *B65H 2404/1141* (2013.01); *B65H 2404/12* (2013.01); *B65H 2701/1912* (2013.01)

(58) Field of Classification Search
CPC ..... B65H 3/0676; B65H 3/66; B65H 9/00; B65H 9/006; B65H 2404/11; B65H 2404/111; B65H 2404/1112; B65H 2404/1113; B65H 2404/1118; B65H 2404/1122; B65H 2404/11221; B65H 2701/1912; G07D 11/00; G07D 11/0027
USPC ..... 271/220
See application file for complete search history.

(56) References Cited

U.S. PATENT DOCUMENTS

| | | | | |
|---|---|---|---|---|
| 7,182,336 | B2 | 2/2007 | Fukushima et al. | |
| 7,182,337 | B2 | 2/2007 | Sasai et al. | |
| 7,654,516 | B2 * | 2/2010 | Terao | B65H 3/0638 271/119 |
| 9,114,942 | B1 * | 8/2015 | Fahilga | B65H 9/106 |
| 10,065,826 | B1 * | 9/2018 | Ruiz | B65H 29/241 |
| 2004/0100014 | A1 * | 5/2004 | Furukawa | B65H 3/0638 271/113 |
| 2008/0136087 | A1 * | 6/2008 | Terao | B65H 3/0638 271/119 |

FOREIGN PATENT DOCUMENTS

| | | | |
|---|---|---|---|
| JP | 2003-072958 | A | 3/2003 |
| JP | 2007-112601 | A | 5/2007 |
| JP | 2008-143617 | A | 6/2008 |
| KR | 10-0918582 | B1 | 9/2009 |
| KR | 10-2011-0003271 | A | 1/2011 |

* cited by examiner

PICKUP ROLLER HAVING FRONT END ALIGNMENT MEMBER AND MEDIUM SEPARATING DEVICE USING SAME

TECHNICAL FIELD

The present disclosure relates to a pick-up roller with a front-edge alignment element and a media separation apparatus using the pick-up roller, and more particularly, to a pick-up roller and a media separation apparatus using the pick-up roller, which is configured to successively pick up and transfer stacked media sheets, and includes a pick-up element protruding from a portion of an outer circumferential surface of the pick-up roller to pick up and transfer a media sheet, and a front-edge alignment element formed of a band-shaped elastic sheet mounted in the form of a curved protrusion to the outer circumferential surface of the pick-up roller at a position opposite to the pick-up element, wherein during a process of picking up the stacked media sheets one by one in a sequence from a front media sheet and transferring it into a space between a feed roller and a separation roller unit by rotation of the pick-up roller, the front-edge alignment element provided on the pick-up roller aligns in advance a front edge of a media sheet disposed subsequent to the picked-up media sheet that is being transferred, to a position of an entrance between the feed roller and the separation roller unit, and thereafter, the pick-up element picks up the media sheet aligned by the front-edge alignment element and transfers it into the space between the feed roller and the separation roller unit, so that not only can the media sheets be prevented from being skewed during the media transfer process, but the media sheets can also be effectively prevented from being separated in a bundle of two or more sheets during a process of separating the media sheets using the feed roller and the separation roller unit, whereby the media sheet separation efficiency can be enhanced.

BACKGROUND ART

Generally, an automated teller machine (ATM) for financial services is an automated machine which can assist in basic financial services such as deposits or withdrawals anytime and anywhere without the need for interaction with bank staff, and which is configured to allow a customer to automatically perform financial transactions such as bill or check withdrawals or deposits using an ATM card or a bankbook.

Depending on financial transactions with customers, the ATM is operated as follows: when a deposit transaction is performed, the ATM receives bills or checks through an deposit/withdrawal unit, separates the bills or checks one by one, transfers and stacks them to and in a temporary storage unit, and then transfers, when the deposit transaction is authorized, them to a cassette and stores them in the cassette; and when a withdrawal transaction is performed, the ATM separates bills or checks stored in the cassette one by one and transfers and provides them to a customer through the deposit/withdrawal unit.

Here, the ATM includes the deposit/withdrawal unit in which media sheets (bills or checks) are stacked, and a media separation apparatus which separates media sheets (bills or checks) stacked in the temporary storage unit or the cassette one by one and transfers them.

FIG. 1 is a diagram illustrating a media separation apparatus for an ATM according to a conventional technique.

FIG. 1 illustrates the structure of a media separation apparatus disclosed in Korean Patent Unexamined Publication No. 2015-0049272, as an example of the media separation apparatus according to the conventional technique. The media separation apparatus according to the conventional technique includes a pick-up roller 21 configured to come into close contact with one of stacked media sheets 10 and pick up it, a feed roller 22 configured to transfer the media sheet 10 picked up by the pick-up roller 21 in a media transfer direction, and a separation roller 23 which is disposed facing the feed roller 22 with the media sheets 10 disposed therebetween and is configured to separate, from the media sheet 10 that is being transferred by the feed roller 22, another media sheet 10 that is brought into close contact with and transferred along with the media sheet 10 that is being transferred by the feed roller 22.

Here, a pick-up element (not shown) is provided on a portion of an outer circumferential surface of the pick-up roller 21 and configured to come into contact with a media sheet 10 and pick up the media sheet 10 using sufficient frictional force between it and the media sheet 10 to transfer the media sheet 10.

In the media separation apparatus having the above-mentioned configuration, the pick-up roller 21 successively picks up the stacked media sheets 10 one by one and transfers it to the feed roller 22. During a process of transferring the media sheet 10 using the feed roller 22, the separation roller 23 which is stationary or is rotated in a direction opposite to that of the feed roller 22 separates, from the media sheet 10 that is being transferred by the feed roller 22, another media sheet 10 that is brought into close contact with and transferred along with the media sheet 10 that is being transferred by the feed roller 22. In this way, the media sheets 10 can be transferred one by one by the feed roller 22 to a transfer path 30.

However, the conventional media separation apparatus is not provided with a separate media alignment unit. Thus, during the process of picking up and transferring the media sheet using the pick-up roller, a front edge of a media sheet disposed subsequent to the media sheet that is picked-up and transferred cannot be correctly aligned to a position an entrance between the feed roller and the separation roller. Therefore, if the stacked media sheets are skewed, a skewed media sheet is inserted into the space between the feed roller and the separation roller as it is, during a media separation process, whereby an error may occur during a following bill read process, or a bill jamming phenomenon on the transfer path may be caused during a transfer process.

DISCLOSURE

Technical Problem

Various embodiments are directed to a pick-up roller and a media separation apparatus using the pick-up roller, which is configured to successively puck up and transfer stacked media sheets, and includes a pick-up element protruding from a portion of an outer circumferential surface of the pick-up roller to pick up and transfer a media sheet, and a front-edge alignment element formed of a band-shaped elastic sheet mounted in the form of a curved protrusion to the outer circumferential surface of the pick-up roller at a position opposite to the pick-up element, wherein during a process of picking up the stacked media sheets one by one in a sequence from a front media sheet and transferring it into a space between a feed roller and a separation roller unit by rotation of the pick-up roller, the front-edge alignment element provided on the pick-up roller aligns in advance a front edge of a media sheet disposed subsequent to the picked-up media sheet that is being transferred, to a position of an entrance between the feed roller and the separation roller unit, and thereafter, the pick-up element picks up the media sheet aligned by the front-edge alignment element and transfers it into the space between the feed roller and the separation roller unit, so that not only can the media sheets be prevented from being skewed during the media transfer process, but the media sheets can also be effectively prevented from being separated in a bundle of two or more sheets during a process of separating the media sheets using the feed roller and the separation roller unit, whereby the media sheet separation efficiency can be enhanced.

Technical Solution

In an embodiment, the present disclosure may provide a pick-up roller provided in a media separation apparatus and configured to pick up stacked media sheets one by one and transfer the picked-up media sheet into a space between a feed roller and a separation roller. The pick-up roller may include: a pick-up roller body configured to rotate to pick up a media sheet; a pick-up element provided on a portion of an outer circumferential surface of the pick-up roller body, and including a contact part protruding outward from the pick-up roller body and configured to come into contact with the media sheet, pick up the contacted media sheet using a frictional force, and transfer the picked-up media sheet into the space between the feed roller and the separation roller; and a front-edge alignment element provided on the outer circumferential surface of the pick-up roller body at a position opposite to the pick-up element, and comprising a band-shaped elastic sheet protruding in a curved shape outward from the pick-up roller body and configured to come into contact with a corresponding media sheet and align a front edge of the contacted media sheet to a position of an entrance between the feed roller and the separation roller.

Advantageous Effects

In a pick-up roller with a front-edge alignment element and a media separation apparatus using the pick-up roller according to the present invention, the pick-up roller includes a pick-up element which is provided on a portion of an outer circumferential surface of a pick-up roller body and configured to pick up and transfer a media sheet, and a front-edge alignment element provided on the outer circumferential surface of the pick-up roller body at a position opposite to the pick-up element. During a process in which, while the pick-up roller rotates, the pick-up element picks up stacked media sheets one by one in a sequence from a front media sheet and transfers it to a space between a feed roller and a separation roller unit, the front-edge alignment element provided on the pick-up roller aligns in advance a front edge of a media sheet disposed subsequent to the media sheet that is picked up and transferred, to a position of an entrance between the feed roller and the separation roller unit. Consequently, the present invention is advantageous in that the media sheets can be prevented from being skewed during the media sheet transfer process.

Furthermore, the pick-up element of the pick-up roller picks up, one by one, the media sheet that has been aligned in advance to the entrance by the front-edge alignment element, and transfers it into the space between the feed roller and the separation roller unit. Therefore, the present invention can prevent the media sheets from being separated in a bundle of two or more sheets during a media separation process using the feed roller and the separation roller unit.

MODE FOR INVENTION

Hereinafter, embodiments of the present invention will be described in detail, but the present invention is not limited to the embodiments described below as long as it does not depart from its spirit and scope.

Figure 1:
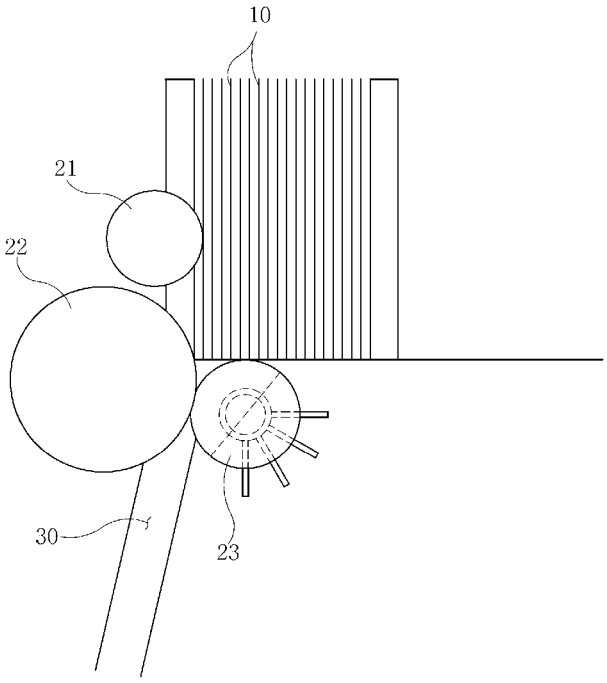
FIG. 1 is a diagram illustrating a media separation apparatus for an automated teller machine (ATM) according to a conventional technique.
Figure 2:
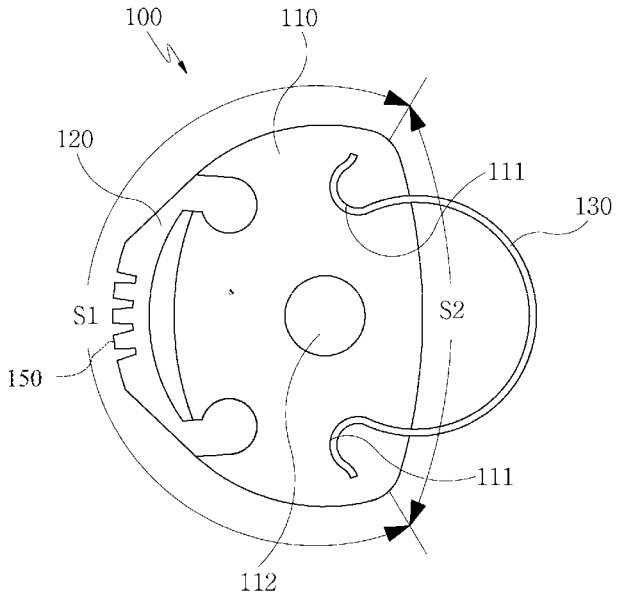
FIG. 2 is a diagram illustrating the structure of a pick-up roller with a front-edge alignment element according to a first embodiment of the present invention.
Figure 3:
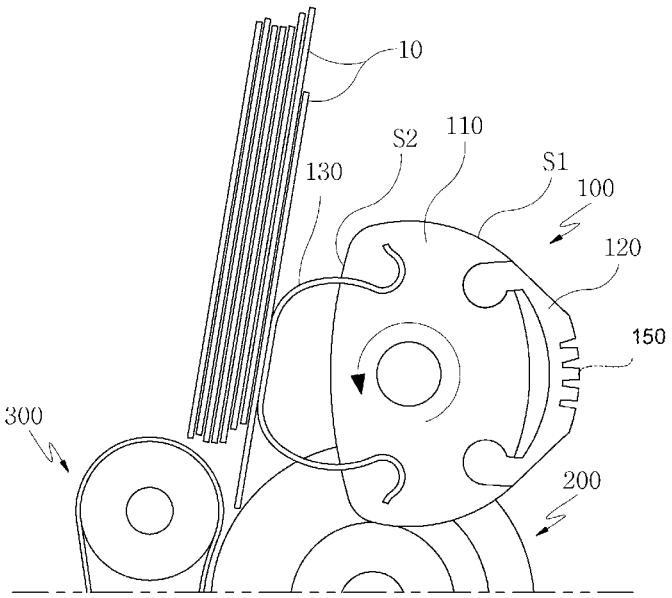
FIG. 3 is a diagram illustrating a process of aligning a front edge of a media sheet using the front-edge alignment element according to the first embodiment of the present invention.

FIG. 2 is a diagram illustrating the structure of a pick-up roller with a front-edge alignment element according to a first embodiment of the present invention, and FIG. 3 is a diagram illustrating a process of aligning a front edge of a media sheet using the front-edge alignment element according to the first embodiment of the present invention.

As shown in FIGS. 2 and 3, the pick-up roller 110 with the front-edge alignment element 130 according to the first embodiment of the present invention includes a pick-up roller body 110, a pick-up element 120, and a front-edge alignment element 130. The pick-up roller body 110 is configured to rotate to pick up media sheets 10. The pick-up element 120 is provided on a portion of an outer circumferential surface of the pick-up roller body 110 and includes a contact part 150 which protrudes outward and comes into contact with a media sheet 10 to pick up the contacted media sheet 10 using frictional force and transfer it into a space between a feed roller 200 and a separation roller unit 300. The front-edge alignment element 130 is provided on the outer circumferential surface of the pick-up roller body 110 at a position opposite to the pick-up element 120 and formed of a band-shaped elastic sheet protruding outward from the body in a curved shape so that the protruding elastic sheet comes into contact with the media sheet 10 and aligns the front edge of the contacted media sheet 10 to an entrance between the feed roller 200 and the separation roller unit 300.

The pick-up roller with the front-edge alignment element according to the first embodiment of the present invention having the above-mentioned structure is configured to successively puck up and transfer stacked media sheets and includes the pick-up element protruding from a portion of the outer circumferential surface of the pick-up roller to pick up and transfer a media sheet, and the front-edge alignment element formed of the band-shaped elastic sheet mounted in the form of a curved protrusion to the outer circumferential surface of the pick-up roller at the position opposite to the pick-up element. During a process of picking up the stacked media sheets one by one in a sequence from a front sheet and transferring it into the space between the feed roller and the separation roller unit by rotation of the pick-up roller, the front-edge alignment element provided on the pick-up roller aligns in advance a front edge of a media sheet disposed subsequent to the picked-up media sheet that is being transferred, to a position of the entrance between the feed roller and the separation roller unit, and thereafter, the pick-up element picks up the media sheet aligned by the front-edge alignment element and transfers it into the space between the feed roller and the separation roller unit. Consequently, the pick-up roller is advantageous in that media sheet separation efficiency can be enhanced not only by preventing the media sheets from being skewed, but also by effectively preventing the media sheets from being separated together in a bundle of two or more sheets during a process of separating the media sheets using the feed roller and the separation roller unit.

Hereinafter, the configuration of the pick-up roller with the front-edge alignment element according to the first embodiment of the present invention will be described in more detail. The pick-up roller body 110 is disposed on a side of the stacked media sheets 10 to pick up the media sheets 10, and rotated by rotating force transmitted from a rotating shaft 112.

In the present embodiment, the pick-up roller body 110 has a relatively planar portion on a portion of the outer circumferential surface thereof. In detail, the pick-up roller body 110 includes a first section S1 an outer circumferential surface of which has an overall arc shape, and a second section S2 an outer circumferential surface of which is relatively planar compared to that of the first section S1.

Furthermore, the pick-up element 120 configured to pick up and transfer the media sheets 10 is mounted to an intermediate portion of the first section S1 on the outer circumferential surface of the pick-up roller body 110.

The pick-up element 120 includes a contact part 150 which protrudes outward from the outer circumferential surface of the pick-up roller body 110 to make contact with the media sheets 10. The pick-up element 120 is configured to pick up each media sheet 10 using frictional force of the contact part 150 and transfer it into the space between the feed roller 200 and the separation roller unit 300.

Here, the pick-up element 120 is made of material having frictional force enough to pick up and transfer the media sheet 10, and generally, formed of rubber or the like.

The front-edge alignment element 130 functioning to align the front edge of the media sheet 10 is provided in the second section S2 on the outer circumferential surface of the pick-up roller body 110.

In detail, the front-edge alignment element 130 is disposed on the pick-up roller body 110 at a position opposite to the pick-up element 120, and formed of the band-shaped elastic sheet that protrudes in a curved shape from the pick-up roller body 110. The front-edge alignment element 130 is configured to make, using the protruding elastic sheet, contact with a media sheet 10 to be separated in a subsequent turn and align the media sheet 10 to the entrance between the feed roller 200 and the separation roller unit 300.

n the present embodiment, as shown in FIGS. 2 and 3, elastic sheet fixing depressions 111 are formed in the pick-up roller body 110 at respective opposite sides of the second section S2, so that the front-edge alignment element 130 formed of the band-shaped elastic sheet is mounted to the pick-up roller body 110 through the elastic sheet fixing depressions 111. Here, the opposite ends of the band-shaped elastic sheet are fitted into the respective elastic sheet fixing depressions 111 that are formed in the pick-up roller body 110 at the opposite sides of the second section S2, in such a way that the band-shaped elastic sheet protrudes from the outer circumferential surface of the second section S2 in a semicircular curved shape, whereby the protruding elastic sheet can make contact with the media sheet 10.

The front-edge alignment element 130 is formed of the elastic sheet made of rubber or foamed urethane to enable the front-edge alignment element 130 to transfer and align the media sheet 10 using frictional force while making contact with the media sheet 10.

In the case where the front-edge alignment element 130 is formed of foamed urethane, there is an advantage in that contact pressure between the front-edge alignment element 130 and the media sheet 10 can be effectively dispersed because the friction coefficient of the foamed urethane is greater than that of rubber.

Therefore, the front-edge alignment element 130 may be elastically deformed by contact with the media sheet 10 so that the front-edge alignment element 130 comes into contact with the media sheet 10 using frictional force less than the frictional force of the pick-up element 120 while transferring the media sheet 10. In this way, the front-edge alignment element 130 functions to align the media sheet 10 to the position of the entrance between the feed roller 200 and the separation roller unit 300.

That is, as shown in FIG. 3, the pick-up element 120 is configured to have a predetermined strength capable of pressing and transferring the media sheet 10 so that, while the pick-up roller 100 rotates, the pick-up element 120 can pick up the media sheet 10 and insert the media sheet 10 into the space between the feed roller 200 and the separation roller unit 300 using sufficient frictional force. On the other hand, the front-edge alignment element 130 is formed of the band-shaped elastic sheet to have relatively low contact force so that the front-edge alignment element 130 is elastically deformed when making contact with the media sheet 10 and then transfers the media sheet 10. Due to this structure, the frictional force between the front-edge alignment element 130 and the media sheet 10 is not enough to insert the media sheet 10 into the space between the feed roller 200 and the separation roller unit 300. Therefore, the front-edge alignment element 130 can function only to align the media sheet 10 to the position of the entrance between the feed roller 200 and the separation roller unit 300.

Here, the frictional force between the front-edge alignment element 130 and the media sheet 10 may be approximately 10% to 50% of the frictional force between the pick-up element 120 and the media sheet 10.

In the above-described embodiment, there has been illustrated an example in which the outer circumferential surface of the pick-up roller includes the first section having an arc shape, and the second section that is relatively planar compared to that of the first section, the pick-up element is provided in the first section, and the front-edge alignment element is provided in the second section. However, the shape of the pick-up roller of the present invention is not limited to the foregoing shape. The pick-up roller of the present invention may have various shapes so long as the pick-up element and the front-edge alignment element are respectively provided on opposite sides of the roller body.

Hereinafter, the media separation apparatus using the pick-up roller with the front-edge alignment element according to the first embodiment having the above-mentioned configuration, and the operation process of the media separation apparatus will be described.

Figure 4:
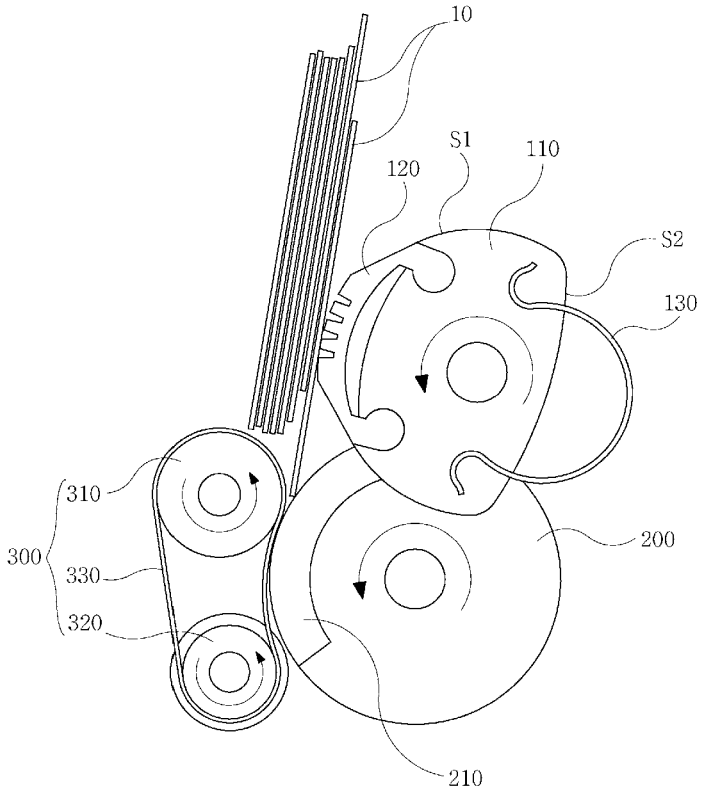
FIG. 4 is a diagram illustrating the structure of a media separation apparatus using the pick-up roller with the front-edge alignment element according to the first embodiment of the present invention.

FIG. 4 is a diagram illustrating the structure of the media separation apparatus using the pick-up roller with the front-edge alignment element according to the first embodiment of the present invention.

As shown in FIG. 4, the media separation apparatus according to the present embodiment includes the feed roller 200, the separation roller unit 300, and the pick-up roller 100. The feed roller 200 includes a frictional element 210 which is provided on a portion of an outer circumferential surface of a roller body thereof and configured to come into contact with a media sheet 10. The feed roller 200 is configured to transfer the media sheet 10 toward a transfer path. The separation roller unit 300 is disposed facing the feed roller 200 and configured to separate, from the media sheet 10 that is being transferred by the feed roller 200, another media sheet 10 that is brought into close contact with and transferred along with the media sheet 10 that is being transferred by the feed roller 200. The pick-up roller 100 is disposed on a side of the stacked media sheets 10 and includes the pick-up element 120 and the front-edge alignment element 130 that are disposed on the respective opposite sides of the outer circumferential surface of the roller body thereof. When the roller body of the pick-up roller 100 rotates, the pick-up element 120 picks up one of the stacked media sheets 10 and transfers it into the space between the feed roller 200 and the separation roller unit 300, and the front-edge alignment element 130 aligns a front edge of a media sheet 10 disposed subsequent to the picked-up media sheet 10 that is being transferred, to the position of the entrance between the feed roller 200 and the separation roller unit 300.

The media separation apparatus according to the present embodiment having the above-mentioned configuration will be described in more detail. The feed roller 200 is disposed at a position spaced apart from the pick-up roller 100 in a media transfer direction, and functions to transfer, toward the transfer path, the media sheet 10 that is picked up and transferred by the pick up roller 100.

Here, the frictional element 210 for making contact with the media sheet 10 is provided on a portion of the outer circumferential surface of the roller body of the feed roller 200. Thus, when the roller body rotates in the media transfer direction, the frictional element 210 that is partially provided on the outer circumferential surface of the roller body of the feed roller 200 rotates along the circumference of the roller body and transfers, toward the transfer path, the media sheet 10 that is picked up and transferred by the pick-up roller 100.

The separation roller unit 300 is disposed facing the feed roller 200 and functions to separate, from the media sheet 10 that is being transferred by the feed roller 200, another media sheet 10 that is brought into close contact with and transferred along with the media sheet 10 that is being transferred by the feed roller 200.

As shown in FIG. 4, in the present embodiment, the separation roller unit 300 includes a pair of separation rollers 310 and 320, and a separation belt 330 wound around the separation rollers 310 and 320. The separation belt 330 is rotated by the separation rollers 310 and 320 in a direction opposite to the media transfer direction, and disposed such that the surface of the separation belt 330 faces a side of the feed roller 200. During a process in which the media sheet 10 that is picked up and transferred by the pick-up roller 100 is transferred toward the transfer path through the space between the feed roller 200 and the separation belt 330, the media sheet 10 that is being transferred by the feed roller 200 can be separated from a undesired media sheet 10 that is brought into contact with the media sheet 10 and transferred along with it, by the friction between the undesired media sheet 10 and the separation belt 330 that rotates in the direction opposite to the media transfer direction.

Here, the separation roller unit 300 may be formed of a single separation roller which is stationary or rotates in the direction opposite to the media transfer direction. In addition, the separation roller unit 300 may have various structures so long as it can separate media sheets one after another.

The pick-up roller 100 is disposed on a side of the stacked media sheets 10 and functions to pick up the stacked media sheets one by one in a sequence from a front sheet and transfer it into the space between the feed roller 200 and the separation roller unit 300.

As described with reference to FIGS. 2 and 3, the pick-up roller 100 includes the pick-up element 120 that is provided on the pick-up roller body 110 in the first section S1 having an arc-shaped circumferential surface and configured to pick up the media sheet 10, and the front-edge alignment element 130 that is provided in the second section S2 having a relatively planar circumferential surface compared to that of the first section S1 and configured to align the front edge of the media sheet 10.

Therefore, during a process in which the pick-up roller body 110 rotates in the media transfer direction, the pick-up element 120 provided on the first section S1 of the pick-up roller body 110 rotates along the circumference of the pick-up roller body 110, picks up the stacked media sheets 10 one by one in a sequence from the front sheet, and transfer it into the space between the feed roller 200 and the separation roller unit 300. Here, the front-edge alignment element 130 provided on the second section S2 of the pick-up roller body 110 aligns in advance a front edge of a media sheet 10 disposed subsequent to the media sheet 10 that is being transferred, to the position of the entrance between the feed roller 200 and the separation roller unit 300. That is, the pick-up element 120 picks up the media sheet 10 that has been aligned by the front-edge alignment element 130, and transfers it into the space between the feed roller 200 and the separation roller unit 300. Consequently, the media sheet separation efficiency can be enhanced not only by preventing the media sheet 10 from being skewed, but also by preventing the media sheets from being separated in a bundle of two or more sheets during the process of separating the media sheets 10 using the feed roller 200 and the separation roller unit 300.

Figure 5:
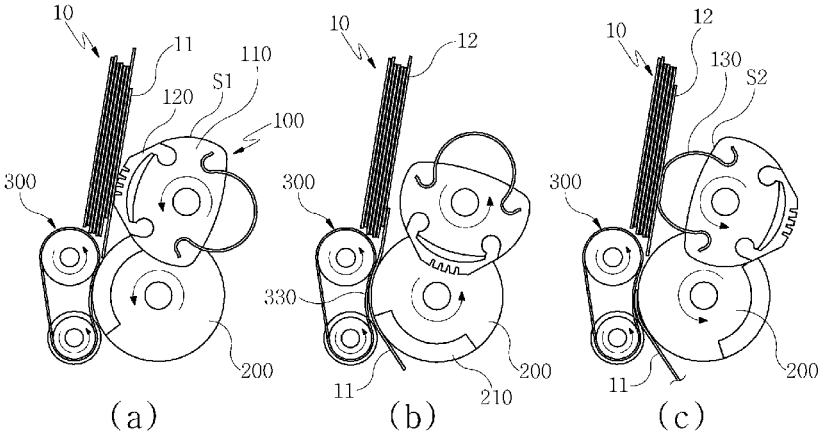
FIG. 5 is a diagram illustrating an operation process of the media separation apparatus using the pick-up roller with the front-edge alignment element according to the first embodiment of the present invention.

FIG. 5 is a diagram illustrating the operation process of the media separation apparatus using the pick-up roller with the front-end alignment unit according to the first embodiment of the present invention.

As shown in (a) of FIG. 5, during a process in which the pick-up roller 100 is rotated by the operation of the media separation apparition, if the first section S1 of the pick-up roller body 110 rotates toward the stacked media sheet 10, the pick-up element 120 provided on the first section S1 of the pick-up roller body 110 picks up a media sheet 11 disposed at the foremost position among the stacked media sheets 10, and transfers it into the space between the feed roller 200 and the separation roller unit 300. Thereby, as shown in (b) of FIG. 5, the media sheet 11 enters the space between the feed roller 200 and the separation roller unit 300.

Subsequently, as shown in (c) of FIG. 5, when the second section S2 of the pick-up roller body 110 rotates toward the stacked media sheets 10, the front-edge alignment element 130 provided on the second section S2 of the pick-up roller body 110 comes into contact with a media sheet 12 disposed subsequent to the media sheet 11 that has been picked up and transferred, and aligns a front edge of the media sheet 12 to the position of the entrance between the feed roller 200 and the separation roller unit 300.

In other words, as shown in (a) and (b) of FIG. 5, even when the media sheets 10 are not aligned with each other, the front-edge alignment element 130 of the pick-up roller 100 can align the front edge of the media sheet 12 to the position of the entrance between the feed roller 200 and the separation roller unit 300, as shown in (c) of FIG. 5. Therefore, in a subsequent turn, the pick-up element 120 of the feed roller 200 can normally pick up the media sheet 12 aligned by the front-edge alignment element 130 and transfer it into the space between the feed roller 200 and the separation roller unit 300.

Here, because the front-edge alignment element 130 is formed of a semicircular band-shaped elastic sheet, it has a comparatively low solidity, so that the frictional force between the front-edge alignment element 130 and the media sheet 10 is not enough to insert the media sheet 10 into the space between the feed roller 200 and the separation roller unit 300. Hence, the front-edge alignment element 130 can function only to align the media sheet 10 to the position of the entrance between the feed roller 200 and the separation roller unit 300.

Thereafter, the first section S1 of the pick-up roller body 110 rotates toward the stacked media sheets 10 again. The pick-up element 120 provided on the first section S1 of the pick-up roller body 110 picks up the media sheet 12 aligned by the front-edge alignment element 130 and transfers it into the space between the feed roller 200 and the separation roller unit 300. As such, during the rotation of the pick-up roller 200, the media sheet alignment operation of the front-edge alignment element 130 and the media pick-up operation of the pick-up element 120 are successively performed. Thereby, the media sheets 10 which are transferred to the space between the feed roller 200 and the separation roller unit 300 can be effectively prevented from being skewed, and the media sheets can be effectively prevented from being separated in a bundle of two or more sheets during the process of separating the media sheets 10 using the feed roller 200 and the separation roller unit 300.

Here, as shown in (b) of FIG. 5, when the media sheet 11 is inserted into the space between the feed roller 200 and the separation roller unit 300, the frictional element 210 of the feed roller 200 rotates in the same phase as that of the pick-up element 120 of the pick-up roller 100 and transfers the inserted media sheet 11 toward the transfer path. During this process, if the subsequent media sheet 12 comes into close contact with a rear surface of the media sheet 11 that is being transferred by the feed roller 200 and is transferred along with the media sheet 11 in a partially overlapped state by the friction between the media sheets 11 and 12, the separation belt 330 of the separation roller unit 300 separates the media sheet 12 from the rear surface of the media sheet 11 using the frictional force between the separation belt 330 and the media sheet 12, thus allowing the media sheets 10 to be separated on a sheet basis and transferred toward the transfer path.

Figure 6:
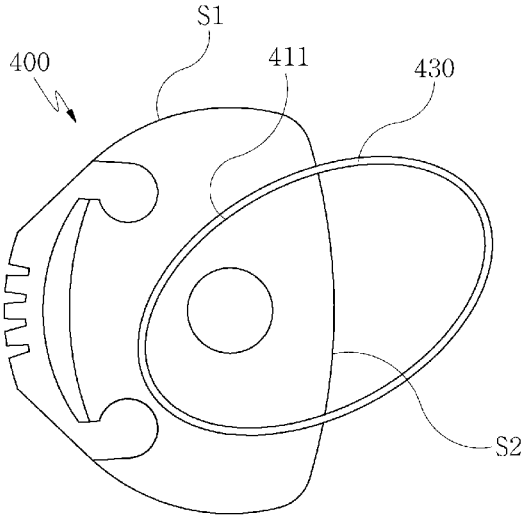
FIG. 6 is a diagram illustrating the structure of a pick-up roller with a front-edge alignment element according to a second embodiment of the present invention.
Figure 7:
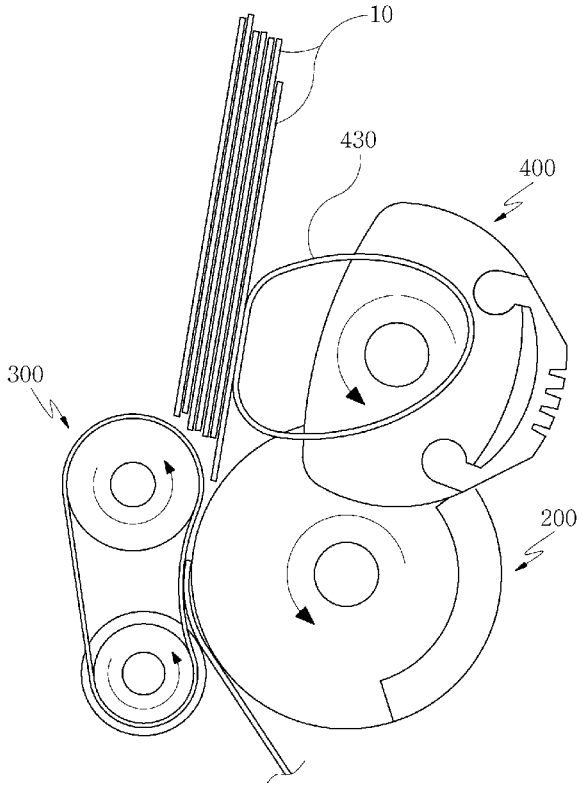
FIG. 7 is a diagram illustrating the structure of a media separation apparatus using the pick-up roller with the front-edge alignment element according to the second embodiment of the present invention.

FIG. 6 is a diagram illustrating the structure of a pick-up roller with a front-edge alignment element according to a second embodiment of the present invention. FIG. 7 is a diagram illustrating the structure of a media separation apparatus using the pick-up roller with the front-edge alignment element according to the second embodiment of the present invention.

The pick-up roller 400 according to the second embodiment of the present invention has the same basic structure as that of the pick-up roller 100 according to the first embodiment, other than the fact that the shape and installation structure of a front-edge alignment element 430 differ from those of the first embodiment.

In detail, as shown in FIG. 6, in the pick-up roller 400 with the front-edge alignment element according to the second embodiment, an elastic sheet fixing depression 411 having a semielliptical slit shape is formed in a second section S2 of a pick-up roller body 410. The front-edge alignment element 430 formed of a loop-shaped elastic sheet is mounted to the pick-up roller body 410 through the elastic sheet fixing depression 411. As such, the loop-shaped elastic sheet is fitted into the elastic sheet fixing depression 411 having a semielliptical slit shape, so that the elastic sheet protruding outward from the outer circumferential surface of the second section S2 forms a semielliptical curved surface, whereby the protruding elastic sheet can come into contact with the media sheet 10.

Here, the elastic sheet fixing depression 411 having a semielliptical slit shape is formed to be inclined toward the direction in which the pick-up roller rotates. Thus, when the front-edge alignment element 430 is mounted to the elastic sheet fixing depression 411, the semielliptical elastic sheet that protrudes outward from the second section S2 is formed to be inclined toward the direction in which the pick-up roller rotates. Therefore, as shown in FIG. 7, during a process in which the pick-up roller 400 is rotated by the operation of the media separation apparatus, the elastic sheet protruding in a semielliptical shape can more easily come into contact with the stacked media sheets 10.

The operation process of the media separation apparatus using the pick-up roller according to the second embodiment may be performed in the same manner as the operation process of the media separation apparatus using the pick-up roller according to the first embodiment.

In the above-mentioned first and second embodiments, there has been illustrated the pick-up roller structure in which the front-edge alignment element protruding in a semicircular or semielliptical shape is formed by reliably fixing the opposite ends of the front-edge alignment element formed of the elastic sheet to the pick-up roller body so that the protruding front-edge alignment element comes into contact with the media sheet and aligns in advance the front edge of the media sheet to the position of the entrance between the feed roller and the separation roller unit. However, in another embodiment of the present invention, the front-edge alignment element protruding from the pick-up roller body may be provided to be partially movable so as to prevent the contact pressure between it and the media sheet from being excessively increased, thus making it possible to more effectively align the media sheet to a desired position in advance. A pick-up roller with the front-edge alignment element having this structure will be described below with reference to a third embodiment.

Figure 8:
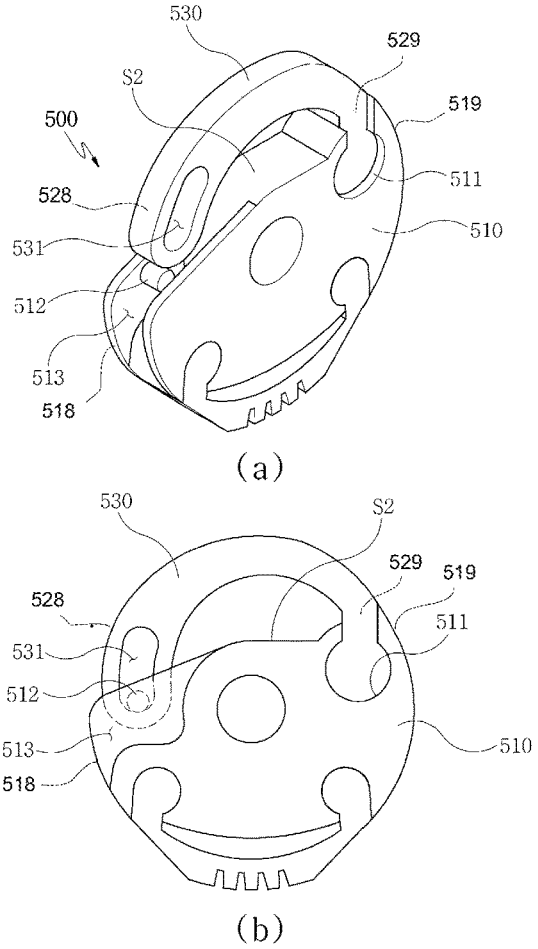
FIG. 8 is a diagram illustrating the structure of a pick-up roller with a front-edge alignment element according to a third embodiment of the present invention.
Figure 9:
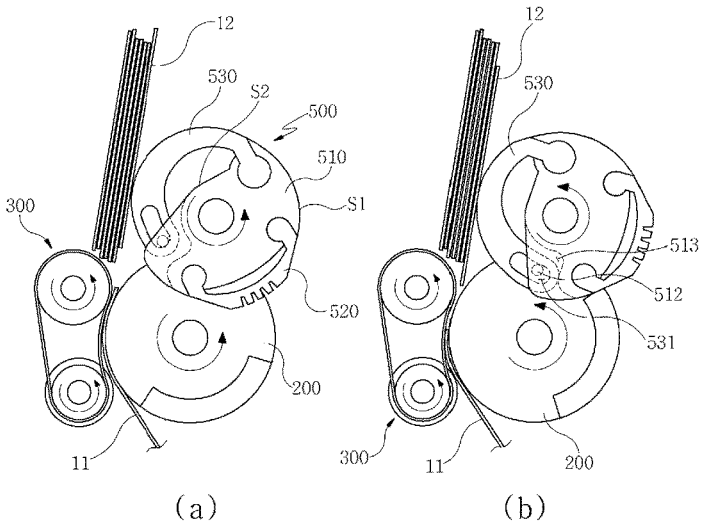
FIG. 9 is a diagram illustrating an operation process of a media separation apparatus using the pick-up roller with the front-edge alignment element according to the third embodiment of the present invention.

FIG. 8 is a diagram illustrating the structure of a pick-up roller with a front-edge alignment element according to the third embodiment of the present invention. FIG. 9 is a diagram illustrating the operation process of a media separation apparatus using the pick-up roller with the front-edge alignment element according to the third embodiment of the present invention.

As shown in (a) of FIG. 8, in the pick-up roller 500 with the front-edge alignment element according to the third embodiment of the present invention, a stop protrusion 512 is provided in a pick-up roller body 510 at a first side portion 518 of the second section S2, and a sheet fixing depression 511 is formed in a second side portion 519 of the second section S2. A front-edge alignment element 530 mounted to the pick-up roller body 510 has a slot 531 in a first end 528 thereof. A second end 529 of the front-edge alignment element 530 is fitted into the sheet fixing depression 511 formed in the pick-up roller body 510 at the second side portion of the second section S2.

Here, the slot 531 formed in the first end 528 of the front-edge alignment element 530 is coupled with the stop protrusion 512 formed in the pick-up roller body 510. The slot 531 is an elongated through hole which is larger than the stop protrusion 512 to allow the first end 528 of the front-edge alignment element 530 to be movably hooked to the stop protrusion 512

Furthermore, an insert depression 513 is formed in the pick-up roller body 510 at the first side portion 518 of the second section in which the stop protrusion 512 is provided. The stop protrusion 512 is disposed in the insert depression 513. Thus, the first end of the front-edge alignment element 530 is inserted into the insert depression 513 of the pick-up roller body 510 and then coupled to the stop protrusion 512 in the insert depression 513 through the slot 531 formed in the first end of the front-edge alignment element 530. Therefore, the first end 528 of the front-edge alignment element 530 that is hooked and coupled to the stop protrusion 512 through the slot 531 can be effectively maintained in the coupled state without being undesirably removed from the stop protrusion 512.

As shown in (b) of FIG. 8, in the pick-up roller 500 with the front-edge alignment element having the above-mentioned configuration, the first end 528 of the front-edge alignment element 530 is hooked and coupled, through the slot 512, to the stop protrusion 512 provided on the first side portion 518 of the second section S2 of the pick-up roller body 510. In this way, the front-edge alignment element 530 formed of an elastic sheet is configured to protrude in a curved shape outward from the outer circumferential surface of the second section S2 of the pick-up roller body 510. Here, unlike the second end of the front-edge alignment element 530 that is integrally fixed to the elastic sheet fixing depression 511 of the pick-up roller body 510, the first end 528 of the front-edge alignment element 530 can be movably coupled to the stop protrusion 512 of the pick-up roller body 510 through the slot 531.

Due to the foregoing configuration, in the pick-up roller with the front-edge alignment element 530 according to the third embodiment, as shown in FIG. 9, during a process of aligning the front edge of the media sheet 12 using the curved elastic sheet of the front-edge alignment element 530, when the media sheet 12 comes into contact with the elastic sheet, the first end 528 of the front-edge alignment element 530 coupled to the stop protrusion 512 through the slot 531 moves along the slot 531 and aligns the front edge of the media sheet 12 making contact therewith, to the position of the entrance between the feed roller 200 and the separation roller unit 300. Therefore, contact pressure between the media sheet 12 and the elastic sheet can be prevented from being excessively increased, whereby the media sheet 12 the front edge of which is aligned can be effectively prevented from being inserted into the space between the feed roller 200 and the separation roller unit 300 by excessive contact pressure of the front-edge alignment element 530.

The operation process of the media separation apparatus using the pick-up roller according to the third embodiment may be performed in the same manner as that of the media separation apparatus using the pick-up roller according to the first embodiment. As shown in (a) of FIG. 9, while the pick-up roller 500 rotates, the pick-up element 520 provided on the first section S1 of the pick-up roller body 510 picks up the media sheet 11 and transfers it into the space between the feed roller 200 and the separation roller unit 300. Thereafter, if the front-edge alignment element 530 provided on the second section S2 of the pick-up roller body 501 comes contact with the media sheet 12 disposed subsequent to the medial sheet 11 that has been picked up and transferred, as shown in (b) of FIG. 9, the elastic sheet of the front-edge alignment element 530 aligns the front edge of the media sheet 12 making contact therewith, to the position of the entrance between the feed roller 200 and the separation roller unit 300. During the foregoing process, the first end 528 of the front-edge alignment element 530 that is hooked and coupled to the stop protrusion 512 of the pick-up roller body 510 through the slot 531 is elastically deformed while moving along the slot 531, and then is retracted into the insert depression 513 of the pick-up roller body 510. Therefore, the pressure at which the front-edge alignment element 530 makes contact with the media sheet 12 can be prevented from be excessively increased, while the front-edge alignment element 530 aligns the front edge of the media sheet 12 making contact therewith, to the position of the entrance between the feed roller 200 and the separation roller unit 300.

As such, in the pick-up roller with the front-edge alignment element according to the third embodiment of the present invention, the first end 528 of the front-edge alignment element provided on the pick-up roller body is provided so as to be partially movable. Thus, when the front-edge alignment element aligns the front edge of the media sheet to the position of the entrance between the feed roller and the separation roller unit, the pressure at which the front-edge alignment element makes contact with the media sheet can be prevented from being excessively increased. Consequently, the media sheet can be more effectively aligned in advance, and the media sheet the front edge of which is aligned can be effectively prevented from being inserted into the space between the feed roller and the separation roller unit by an excessive contact pressure between the media sheet and the front-edge alignment element.

In the above-mentioned first to third embodiments, there have been illustrated examples in which the pick-up roller with the front-edge alignment element is configured in such a way that the elastic sheet fixing depression is formed in the second section of the pick-up roller body, and the elastic sheet is fitted into the elastic sheet fixing depression so that the elastic sheet protrudes in a curved shape outward from the outer circumferential surface of the second section of the pick-up roller body. However, the present invention is not limited to the foregoing embodiments. For example, the pick-up roller may have various structures in which the front-edge alignment element is integrally provided on the second section of the pick-up roller body.

That is, the front-edge alignment element may adhere to the pick-up roller body by a method such as adhesive bonding, or thermosetting bonding. Alternatively, the front-edge alignment element may be integrally formed with the pick-up roller body through an injection molding process.

As described above, in a pick-up roller with a front-edge alignment element and a media separation apparatus using the pick-up roller according to the present invention, the pick-up roller includes a pick-up element which is provided on a portion of an outer circumferential surface of a pick-up roller body and configured to pick up and transfer a media sheet, and a front-edge alignment element provided on the outer circumferential surface of the pick-up roller body at a position opposite to the pick-up element. During a process in which, while the pick-up roller rotates, the pick-up element picks up stacked media sheets one by one in a sequence from a front media sheet and transfers it to a space between a feed roller and a separation roller unit, the front-edge alignment element provided on the pick-up roller aligns in advance a front edge of a media sheet disposed subsequent to the media sheet that is picked up and transferred, to a position of an entrance between the feed roller and the separation roller unit. Consequently, the present invention is advantageous in that the media sheets can be prevented from being skewed during the media sheet transfer process.

Furthermore, the pick-up element of the pick-up roller picks up, one by one, the media sheet that has been aligned in advance to the entrance by the front-edge alignment element, and transfers it into the space between the feed roller and the separation roller unit. Therefore, the present invention can prevent the media sheets from being separated in a bundle of two or more sheets during a media sheet separation process using the feed roller and the separation roller unit.

While various embodiments have been described above, it will be understood to those skilled in the art that the embodiments described are by way of example only. Accordingly, the disclosure described herein should not be limited based on the described embodiments.

INDUSTRIAL APPLICABILITY

A pick-up roller with a front-edge alignment element and a media separation apparatus using the pick-up roller according to the present invention are provided in a cassette of an ATM so as to separate, one by one, media sheets (bills or checks) to be deposited or withdrawn. During a process in which, while the pick-up roller rotates, a pick-up element picks up stacked media sheets one by one in a sequence from a front media sheet and transfers it to a space between a feed roller and a separation roller unit, the front-edge alignment element provided on the pick-up roller aligns in advance a front edge of a media sheet disposed subsequent to the media sheet that is picked up and transferred, to a position of an entrance between the feed roller and the separation roller unit. Therefore, not only can the media sheets be effectively prevented from being skewed during the media sheet transfer process, but the media sheets can also be effectively prevented from being separated in a bundle of two or more sheets during a media sheet separation process using the feed roller and the separation roller unit. Thereby, media separation efficiency can be improved. As a result, the present invention can contribute to improvement in performance and operation efficiency of the ATM.

The invention claimed is:

1. A pick-up roller provided in a media separation apparatus and configured to pick up stacked media sheets one by one and transfer a picked-up media sheet into a space between a feed roller and a separation roller, the pick-up roller comprising:

a pick-up roller body configured to rotate;

a front-edge alignment element provided on an outer circumferential surface of the pick-up roller body, and comprising a band-shaped elastic sheet protruding in a curved shape outward from the pick-up roller body and configured to come into contact with a media sheet and align a front edge of the media sheet to a position of an entrance between the feed roller and the separation roller; and a pick-up element provided on a portion of the outer circumferential surface of the pick-up roller body at a position opposite to the front-edge alignment element, and including a contact part protruding outward from the pick-up roller body and configured to come into contact with the media sheet, pick up the media sheet using a frictional force, and transfer the media sheet into the space between the feed roller and the separation roller, wherein the pick-up roller body includes a first section an outer circumferential surface of which has an overall arc shape, and a second section an outer circumferential surface of which is relatively planar compared to the outer circumferential surface of the first section, wherein the pick-up element is provided on the circumferential surface of the first section, and the front-edge alignment element is provided on the circumferential surface of the second section, and wherein the front-edge alignment element is bonded to the second section of the pick-up roller body through a bonding process using an adhesive or a thermosetting bonding process.

2. A pick-up roller provided in a media separation apparatus and configured to pick up stacked media sheets one by one and transfer a picked-up media sheet into a space between a feed roller and a separation roller, the pick-up roller comprising:

a pick-up roller body configured to rotate;

a front-edge alignment element provided on an outer circumferential surface of the pick-up roller body, and comprising a band-shaped elastic sheet protruding in a curved shape outward from the pick-up roller body and configured to come into contact with a media sheet and align a front edge of the media sheet to a position of an entrance between the feed roller and the separation roller; and a pick-up element provided on a portion of the outer circumferential surface of the pick-up roller body at a position opposite to the front-edge alignment element, and including a contact part protruding outward from the pick-up roller body and configured to come into contact with the media sheet, pick up the media sheet using a frictional force, and transfer the media sheet into the space between the feed roller and the separation roller, wherein the pick-up roller body includes a first section an outer circumferential surface of which has an overall arc shape, and a second section an outer circumferential surface of which is relatively planar compared to the outer circumferential surface of the first section, wherein the pick-up element is provided on the circumferential surface of the first section, and the front-edge alignment element is provided on the circumferential surface of the second section, wherein the pick-up roller body includes elastic sheet fixing depressions formed in respective opposite side portions of the second section, and wherein the front-edge alignment element is configured by fitting opposite ends of the band-shaped elastic sheet into the respective elastic sheet fixing depressions formed on the opposite side portions of the second section such that the elastic sheet protruding outward from the outer circumferential surface of the second section forms a semicircular curved surface.

3. A pick-up roller provided in a media separation apparatus and configured to pick up stacked media sheets one by one and transfer a picked-up media sheet into a space between a feed roller and a separation roller, the pick-up roller comprising:

a pick-up roller body configured to rotate;

a front-edge alignment element provided on an outer circumferential surface of the pick-up roller body, and comprising a band-shaped elastic sheet protruding in a curved shape outward from the pick-up roller body and configured to come into contact with a media sheet and align a front edge of the media sheet to a position of an entrance between the feed roller and the separation roller; and a pick-up element provided on a portion of the outer circumferential surface of the pick-up roller body at a position opposite to the front-edge alignment element, and including a contact part protruding outward from the pick-up roller body and configured to come into contact with the media sheet, pick up the media sheet using a frictional force, and transfer the media sheet into the space between the feed roller and the separation roller, wherein the pick-up roller body includes a first section an outer circumferential surface of which has an overall arc shape, and a second section an outer circumferential surface of which is relatively planar compared to the outer circumferential surface of the first section, wherein the pick-up element is provided on the circumferential surface of the first section, and the front-edge alignment element is provided on the circumferential surface of the second section, wherein the pick-up roller body has an elastic sheet fixing depression formed of a semielliptical slit inside the outer circumferential surface of the second section, and wherein the front-edge alignment element is configured by fitting a portion of a loop-shaped elastic sheet into the elastic sheet fixing depression such that the elastic sheet protruding outward from the outer circumferential surface of the second section forms a semielliptical curved surface.

4. The pick-up roller according to claim 3, wherein the elastic sheet fixing depression is formed in such a way that the semielliptical slit is inclined in a rotation direction of the pick-up roller, so that the elastic sheet forming the semielliptical surface and protruding outward from the outer circumferential surface of the second section is inclined in the rotation direction of the pick-up roller.

5. A pick-up roller provided in a media separation apparatus and configured to pick up stacked media sheets one by one and transfer the picked-up media sheet into a space between a feed roller and a separation roller, the pick-up roller comprising:

a pick-up roller body configured to rotate;

a front-edge alignment element provided on an outer circumferential surface of the pick-up roller body, and comprising a band-shaped elastic sheet protruding in a curved shape outward from the pick-up roller body and configured to come into contact with a media sheet and align a front edge of the media sheet to a position of an entrance between the feed roller and the separation roller; and a pick-up element provided on a portion of the outer circumferential surface of the pick-up roller body at a position opposite to the front-edge alignment element, and including a contact part protruding outward from the pick-up roller body and configured to come into contact with the media sheet, pick up the media sheet using a frictional force, and transfer the media sheet into the space between the feed roller and the separation roller, wherein the pick-up roller body includes a first section an outer circumferential surface of which has an overall arc shape, and a second section an outer circumferential surface of which is relatively planar compared to the outer circumferential surface of the first section, wherein the pick-up element is provided on the circumferential surface of the first section, and the front-edge alignment element is provided on the circumferential surface of the second section, wherein the pick-up roller body includes a stop protrusion provided in a first side portion of the second section, and an elastic sheet fixing depression formed in a second side portion of the second section, wherein the front-edge alignment element includes a slot formed in a first end thereof, and a second end of the front-edge alignment element is fitted into the elastic sheet fixing depression formed in the second side portion of the second section, and wherein the front-edge alignment element is movably hooked and coupled, through the slot formed in the first end, to the stop protrusion provided in the first side portion of the second section of the pick-up roller body, in such a way that the elastic sheet protrudes in a curved shape outward from the outer circumferential surface of the second section.

6. The pick-up roller according to claim 5, wherein the pick-up roller body includes an insert depression formed in the first side portion of the second section so that the first end of the front-edge alignment element is inserted into the insert depression, and wherein the stop protrusion is disposed in the insert depression.

* * * * *